US006390616B2

(12) United States Patent
Shinada et al.

(10) Patent No.: US 6,390,616 B2
(45) Date of Patent: May 21, 2002

(54) METHOD FOR MANUFACTURING INK CARTRIDGES

(75) Inventors: Satoshi Shinada; Takahiro Naka; Hisashi Koike; Tomio Yokoyama; Kazunori Ito, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/773,368

(22) Filed: Feb. 1, 2001

(30) Foreign Application Priority Data

Feb. 2, 2000 (JP) ..... 2000-025725

(51) Int. Cl.[7] ..... B41J 2/175

(52) U.S. Cl. ..... 347/86

(58) Field of Search ..... 347/84, 85, 86, 347/87

(56) References Cited

U.S. PATENT DOCUMENTS

| | | | | |
|---|---|---|---|---|
| 5,567,373 | A | 10/1996 | Sato et al. | 264/112 |
| 5,659,345 | A | 8/1997 | Altendorf | 347/87 |
| 5,790,157 | A | 8/1998 | Higuma et al. | 347/85 |
| 5,790,158 | A | 8/1998 | Shinada et al. | 347/86 |
| 5,839,595 | A | 11/1998 | Ujita | 220/4.21 |
| 5,875,615 | A | 3/1999 | Ito et al. | 53/474 |

*Primary Examiner*—Anh T. N. Vo
(74) *Attorney, Agent, or Firm*—Sughrue Mion, PLLC

(57) ABSTRACT

The present invention relates to a method for manufacturing an ink cartridge. The ink cartridge has a container having storage chambers and porous members for holding ink. The porous member is stored in the corresponding storage chambers. The container has ink supply ports for conducting ink from the storage chambers. Before insertion, each porous member is inclined relative to the storage chamber and inserted into the storage chamber through an opening of the container. Therefore, the porous members are easily inserted.

19 Claims, 8 Drawing Sheets

METHOD FOR MANUFACTURING INK CARTRIDGES

BACKGROUND OF THE INVENTION

The present invention relates to a method for manufacturing printer ink cartridges.

A typical ink jet printer has an ink cartridge containing ink. In printing, the ink is supplied to a printer body from the ink cartridge and ejected from a printing head, which is mounted on the printer body, to a recording paper.

The ink cartridge contains a porous member, such as a sponge. The porous member, which has a capillary effect, holds ink in the cartridge. Therefore, the ink is adequately supplied to the printer body from the cartridge. The porous member is inexpensive and easy to manufacture, so that the cost of the cartridge is reduced.

FIGS. 8(*a*), 8(*b*), and 8(*c*) show a conventional ink cartridge container 52 and a porous member 51, which is contained in the container 52. The container 52 is a relatively simple, rectangular parallelepiped. The shape of each porous member 51 is substantially the same as that of the container 52. When the porous member 51 is inserted into the container 52, the porous member 51 is first positioned above and parallel to the container 52, as shown in FIG. 8(*a*). Then, as shown in FIG. 8(*b*), the porous member 51 is moved toward the container 52 and into the container 52 through an upper opening. However, the upper edge of the container 52, interferes with the bottom of the porous member 51, so that the porous member 51 is difficult to insert.

As shown in FIG. 8(*c*), an internal projection 53 is formed on the bottom surface of the container 52. The projection 53 is provided with an outlet mechanism 54 for conducting ink from the container 52. When the porous member 51 is inserted into the container 52, the porous member 51 contacts the projection 53, so that the porous member 51 does not fill the container 52 and does not reach the internal bottom surface of the container 52. Therefore, a gap is created between the internal bottom surface of the container 52 and the porous member 51.

Japanese Unexamined Patent Publication No. 8-224887 discloses an ink cartridge having a container and porous members. The container and the porous members both have simply shaped components. The container, which accommodates the porous members, is formed by assembling the components. Although the container has a relatively complicated shape, the simple shapes of the components permit the porous members to be easily placed in the container. However, since the components must be assembled to be liquid-tight, the manufacture is complicated.

SUMMARY OF THE INVENTION

It is an object of the present invention to provide a method for manufacturing an ink cartridge that facilitates the insertion of a porous member into a container without increasing the number of components.

To achieve the above object, the present invention provides a method for manufacturing an ink cartridge. The ink cartridge has a container having a substantially parallelepiped storage chamber and a substantially parallelepiped porous member for holding ink. The porous member is contained in the storage chamber. The container has an ink supply port for conducting ink from the storage chamber. The porous member is inserted into the storage chamber through an opening of the container while inclining the porous member relative to the storage chamber.

The present invention further provides a method for manufacturing an ink cartridge. The ink cartridge has a container having a storage chamber and a porous member for holding ink. The porous member is contained in the storage chamber. The container has an ink supply port for conducting ink from the storage chamber. The method includes compressing and deforming the bottom surface of the porous member to substantially conform to the bottom surface of the storage chamber and inserting the porous member into the storage chamber through an opening of the container after the compression of the bottom surface of the porous member.

The present invention further provides a method for manufacturing an ink cartridge. The ink cartridge includes a container having a storage chamber and a porous member for holding ink. The porous member is contained in the storage chamber. The method includes inserting the porous member into the storage chamber through an opening of the container, compressing the inserted porous member toward the bottom surface of the storage chamber, and attaching a lid to the container to close the opening of the container after the compression of the porous member.

The present invention further provides a method for manufacturing an ink cartridge. The ink cartridge includes a container having a plurality of storage chambers and a plurality of porous members for holding ink. Each porous member is contained in one of the storage chambers. The method includes inserting the porous members into the storage chambers. Each adjacent pair of the porous members are inserted into the corresponding storage chambers at a predetermined time interval.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
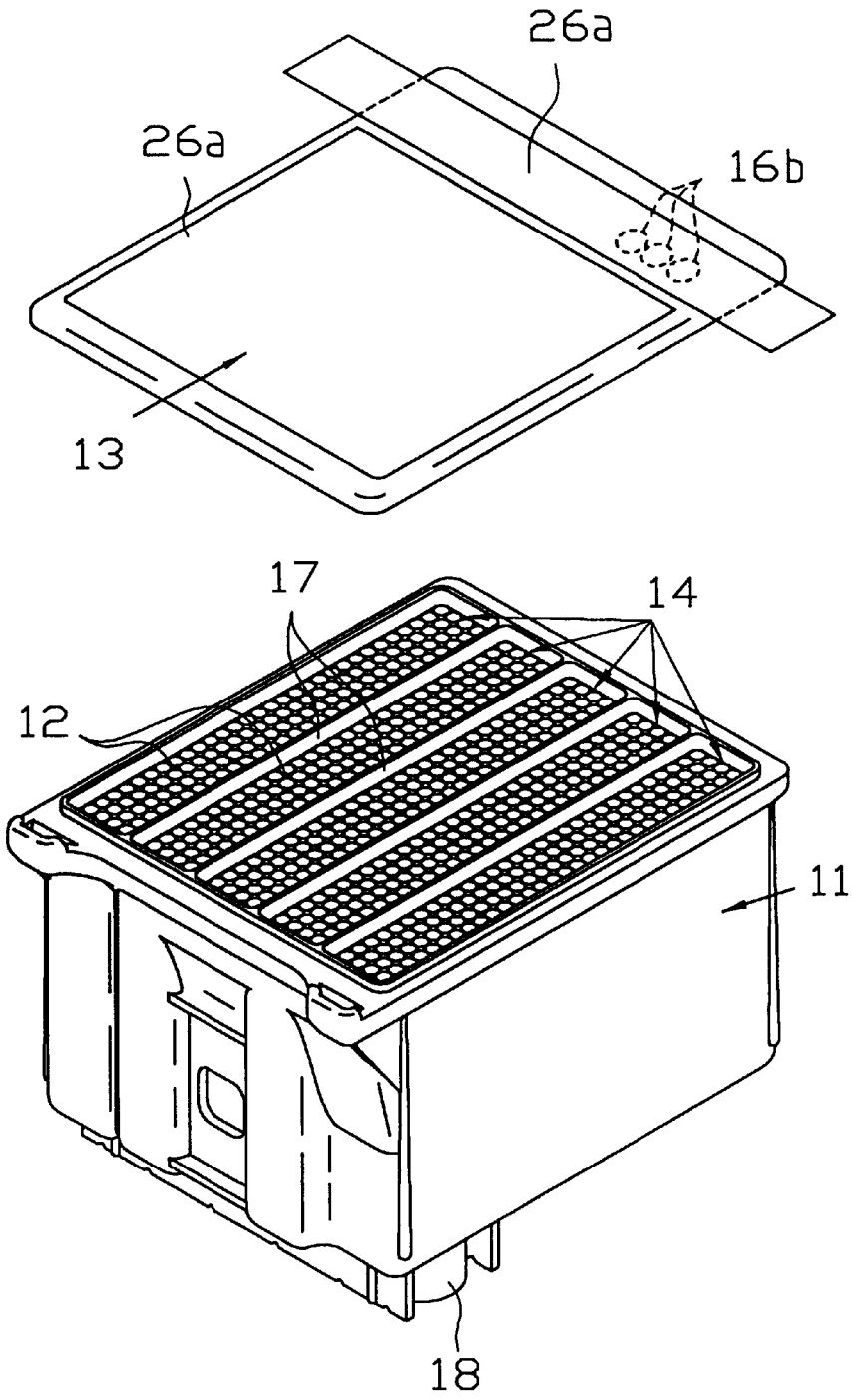
FIG. 1 is a perspective view showing an ink cartridge.
Figure 2:
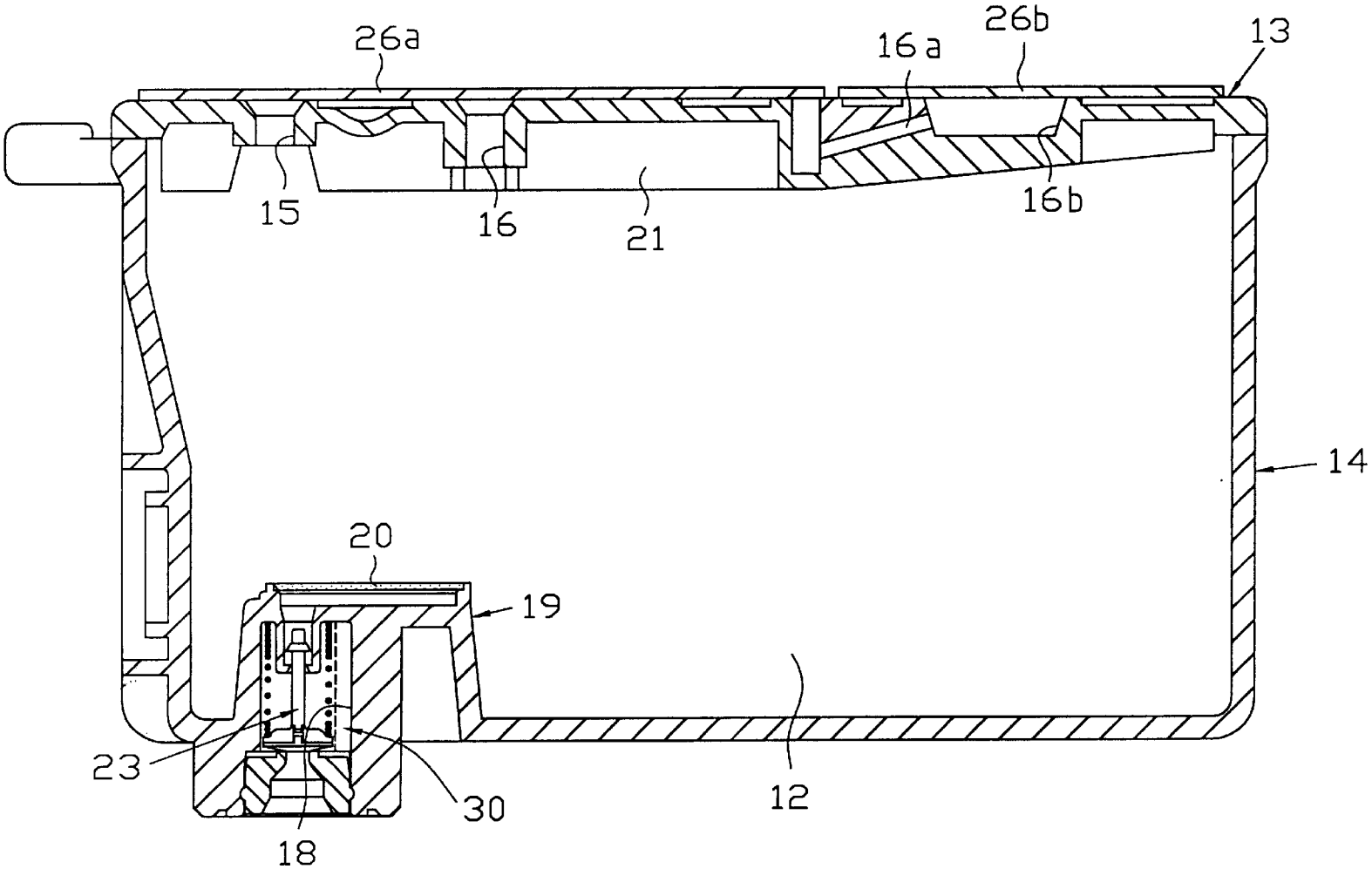
FIG. 2 is a cross sectional view of the ink cartridge illustrated in FIG. 1.

Embodiment of the present invention will be described according to FIGS. 1 to 7(*c*). The ink cartridge illustrated in FIGS. 1 and 2 is mounted on an ink jet printer (not shown). The cartridge includes a container 11 and a lid 13, which are made from a synthetic resin, and a plurality of porous members 12, such as sponges. The container 11 is substantially a rectangular parallelepiped and has an upper opening. The container 11 has storage chambers 14, the number of which is five in this embodiment. The storage chambers 14 are divided by partition walls 17. The storage chambers 14 have substantially the same shape and are in parallel. The internal surface of the lid 13 is provided with pairs of ribs 21. Each pair of ribs 21 corresponds to one of the storage chambers 14. The ribs 21 extend substantially parallel to the walls 17. Between each adjacent pair of ribs 21, the lid 13 is provided with an ink inlet 15 and an air hole 16.

The bottom surface of each storage chamber 14 is provided with an internal projection 19. The projection 19, as shown in FIG. 2, is located close to an end of the corresponding storage chamber 14. An ink outlet mechanism 30 has an ink supply port 18 to conduct ink to a printer body from the corresponding storage chamber 14. The upper opening of the supply port 18 has a filter 20. A valve mechanism 23 is provided in the supply port 18. When the container 11 is installed in a printer body, an ink lead-through needle of the printer body (not shown) is inserted into the supply port 18, which opens the valve mechanism 23. As a result, the ink outlet mechanism 30 supplies ink to the printer body from the storage chamber 14.

The upper surface of the lid 13 has air paths 16*a*, which include a narrow groove and a narrow hole. One of the paths 16*a* corresponds with each chamber 14. Although not illustrated, each air hole 16 is connected with a corresponding air opening 16*b* through one of the paths 16*a*. The air openings 16*b* are formed on the upper surface of the lid 13. Seals 26*a* and 26*b* are attached to the upper surface of the lid 13. The seal 26*a* seals each ink inlet 15 and each hole 16, and the seal 26*b* seals each opening 16*b*.

Since the container 11 is hermetically sealed prior to use, ink can not leak from the container 11. When preparing to use the cartridge, the seal 26*b* is removed and are opened. Each storage chamber 14 communicates with outside air through the corresponding hole 16, path 16*a* and opening 16*b*. Therefore, the ink in each storage chamber 14 is conducted out through a corresponding ink supply port 18.

Each porous member 12, which has a plurality of pores, is made from elastic material. The porous member 12 contains many connected air pockets. When deformed, the material of the porous member 12 gradually returns to its original shape. Each porous member 12 fills one of the storage chambers 14.

The lid 13 is welded to the container 11 by, for example, vibration bonding, to close the upper opening of the container 11 with a liquid-tight seal. Ink is injected through the ink inlets 15 to the storage chambers 14 and is contained in the porous members 12. The ink is absorbed in and spreads throughout each porous member 12 by the capillary effect. The ink stored in each porous member 12 is conducted to the printer body through the supply port 18.

A method for manufacturing the ink cartridge of FIGS. 1 and 2 is explained according to FIGS. 3 to 7.

Figure 3B:
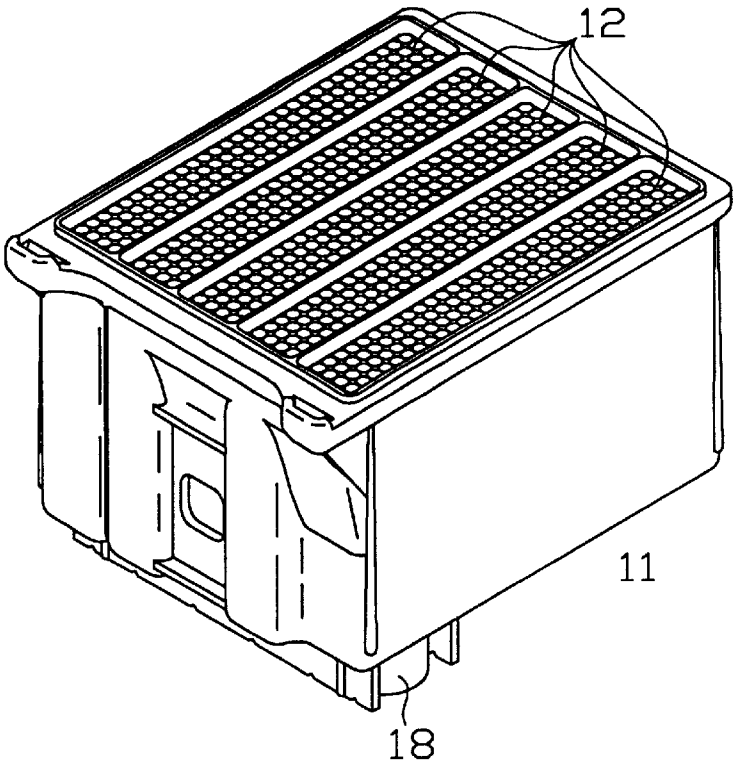
FIGS. 3(*a*) and 3(*b*) are perspective views showing steps of inserting porous members into a plurality of storage chambers of the ink cartridge illustrated in FIG. 1.
Figure 3A:
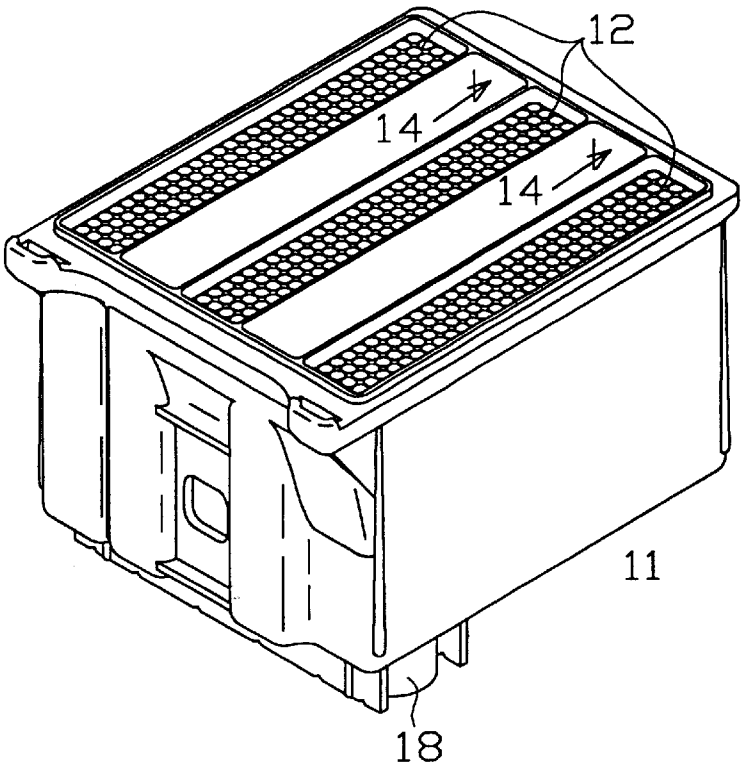

As shown in FIG. 3(*a*), three of the porous members 12 are inserted into the corresponding storage chambers 14 at one chamber intervals. That is, every other porous member 12 is installed. Then, as shown in FIG. 3(*b*), the remaining porous members 12 are inserted into the corresponding storage chambers 14.

Figure 4A:
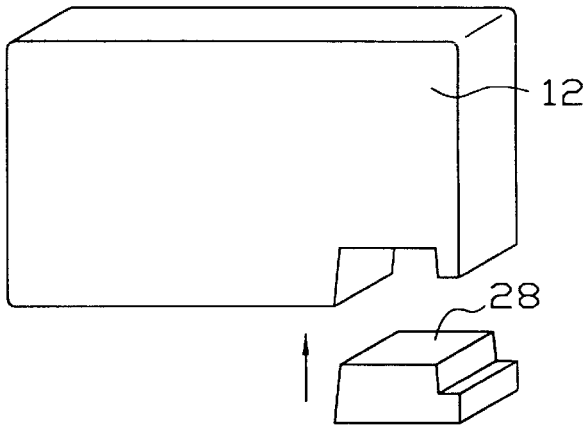
FIGS. 4(*a*), 4(*b*), and 4(*c*) illustrate steps of deforming a porous member before it is inserted into a storage chamber.
Figure 4B:
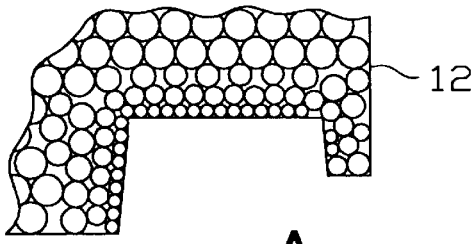
Figure 4C:
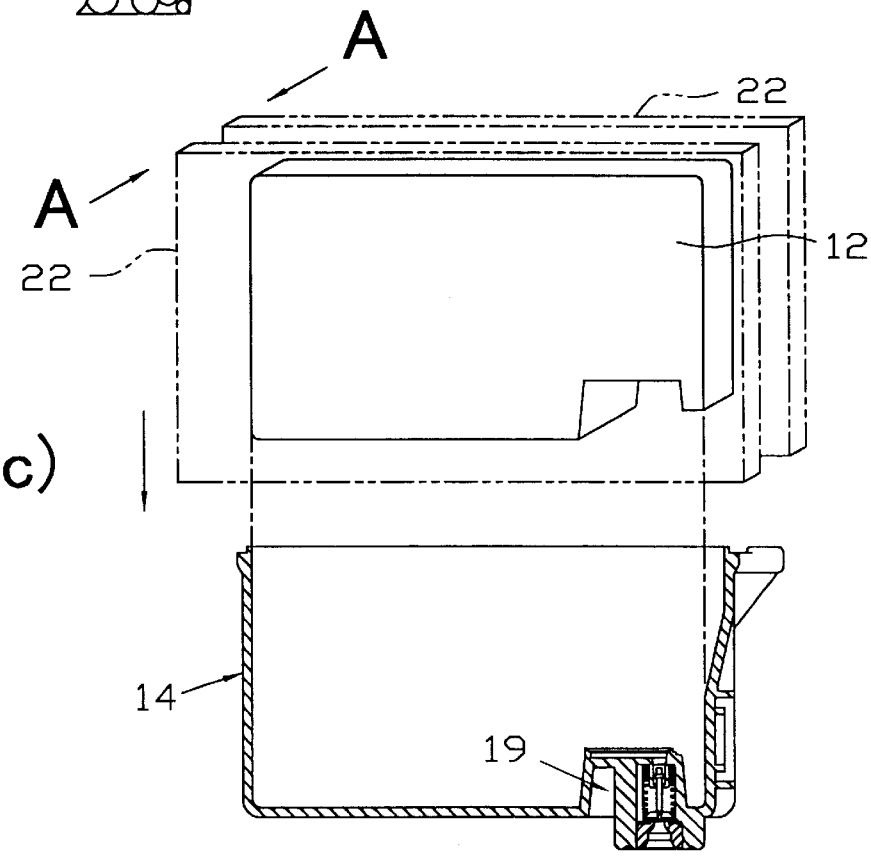

Before being inserted, each porous member 12 is compressed and deformed so that the shape of the porous member 12 is suitable for the insertion. More specifically, as shown in FIG. 4(*a*), a jig 28 is used. The jig 28 has a projection, the shape of which is substantially the same as that of the projection 19, which is located on the internal bottom surface of each storage chamber 14. The jig 28 is pressed against the bottom surface of the porous member 12 to compress and deform the bottom surface. As a result, the bottom surface of each porous member 12 substantially conforms to the internal surface of the storage chambers 14. As shown in FIG. 4(*b*), in the deformed portion of the porous member 12, the inner air pockets, which are represented by circles, are contracted.

Next, as shown in FIG. 4(*c*), the porous member 12 is held between a pair of jig plates 22. The jig plates 22 compress the porous member 12 in the lateral direction (as shown by the arrow A). Then, the jig plates 22 release the porous member 12 and the porous member 12 is inserted into the corresponding storage chamber 14.

Figure 5B:
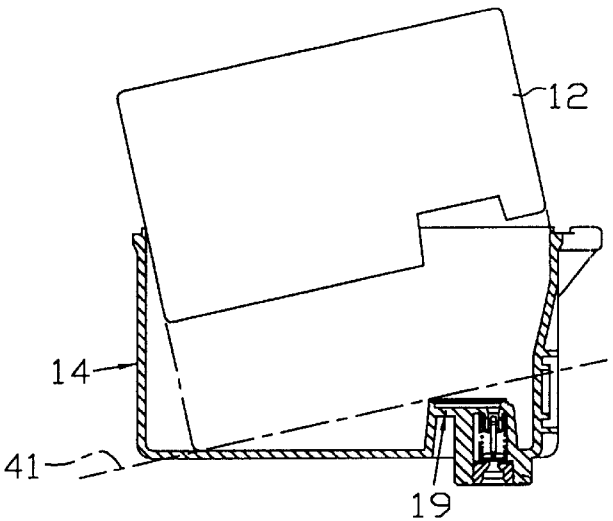
FIGS. 5(*a*), 5(*b*), and 5(*c*) are cross sectional views showing steps of inserting a porous member into a storage chamber while the porous member is inclined.
Figure 5C:
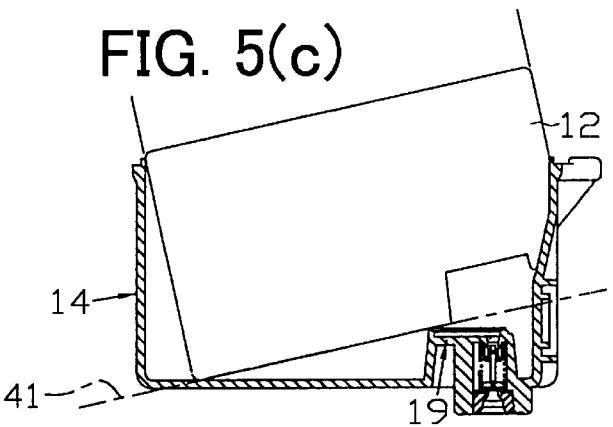
Figure 5A:
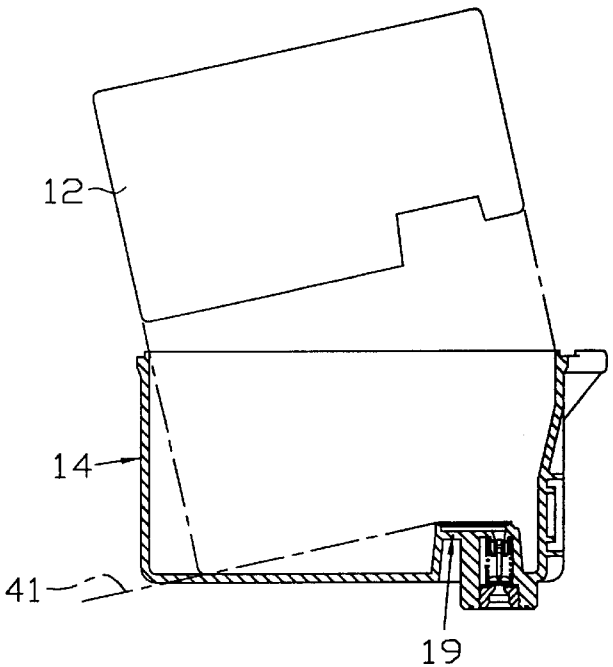

While being inserted into the corresponding storage chamber 14, each porous member 12 is inclined relative to the container 11. More specifically, as shown in FIG. 5(*a*), the porous member 12 is first positioned above the corresponding storage chamber 14. At the same time, the porous member 12 is inclined relative to the corresponding storage chamber 14 such that the end that corresponds to the projection 19 is further away from the container 11 than the opposite end. The porous member 12 is inserted into the corresponding storage chamber 14 while inclined as shown in FIG. 5(*b*).

The inclination of the porous member 12 relative to the container 11 is determined as follows. The bottom surface of the porous member 12 is parallel to an imaginary inclined plane 41, which extends between the point where the bottom left corner (as viewed in FIG. 5(*c*)) contacts the bottom surface of the storage chamber 14 and the top of the projection 19 while the left end of the porous member 12 contacts the upper edge of the container 11. The inclination of the porous member 12 is such that imaginary lines, which extend from both right and left sides of the porous member 12, are within the opening of the storage chamber 14 as shown in FIG. 5(*a*).

When the porous member 12 is inserted into the storage chamber 14 as shown in FIG. 5(*c*), the porous member 12 contacts with the projection 19. Above the projection 19, an upper corner of the porous member 12 projects from the opening of the storage chamber 14

Figure 6B:
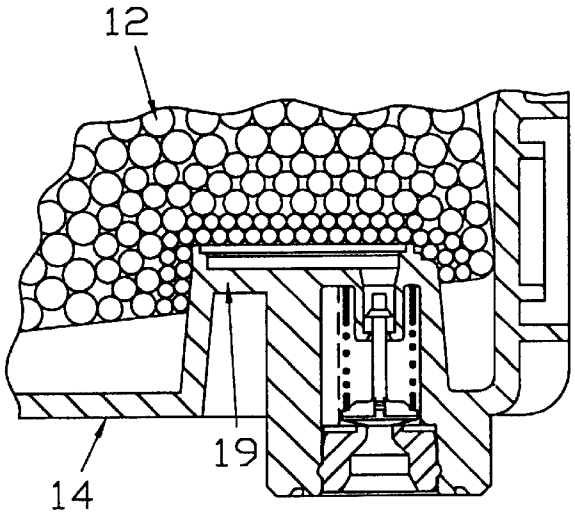
FIGS. 6(*a*) and 6(*b*) are cross sectional views showing insertion of a porous member into storage a chamber.
Figure 6A:
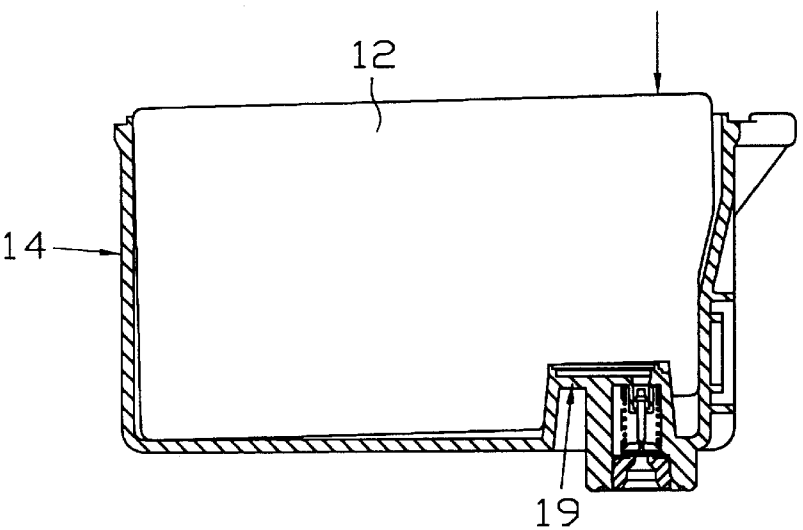

As shown in FIG. 6(*a*), the upper part of the porous member 12 is pressed toward the corresponding storage chamber 14. The bottom of the porous member 12 is already compressed and deformed to substantially conform to the internal bottom surface of the storage chamber 14. Therefore, an indented portion of the bottom of the porous member 12 engages the projection 19. As shown in FIG. 6(*b*), the projection 19 causes the indentation to remain.

Figure 7B:
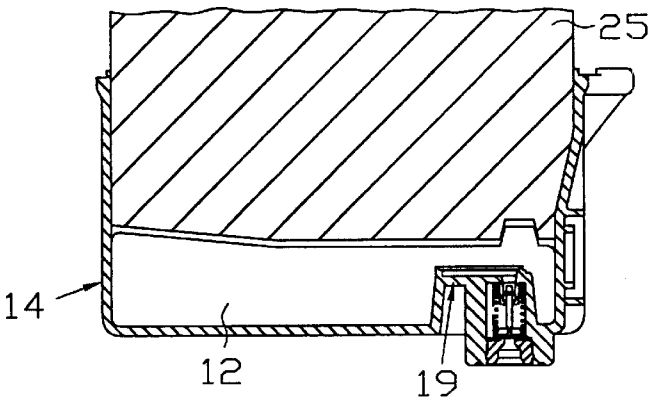
FIGS. 7(*a*), 7(*b*), and 7(*c*) are cross sectional views of showing a porous member illustrated in FIG. 6(*a*) being compressed against a storage chamber.
Figure 7A:
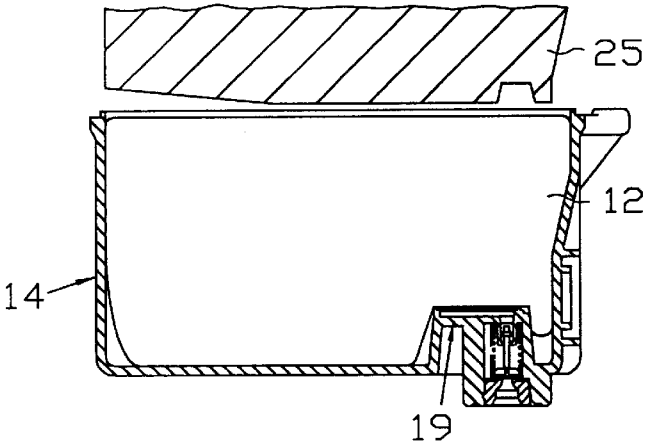
Figure 7C:
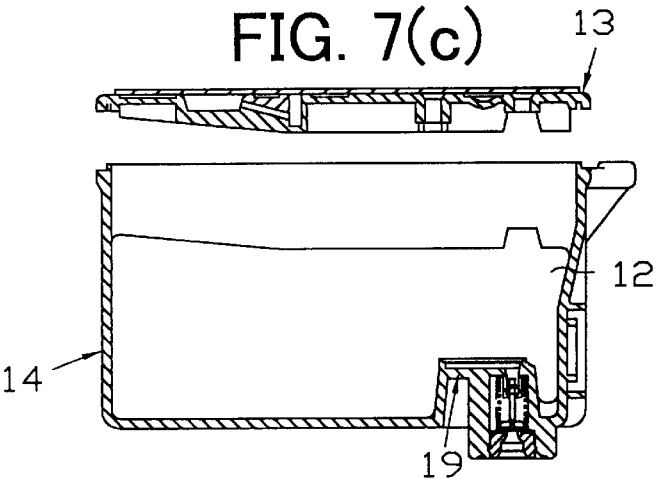
Figure 8B:
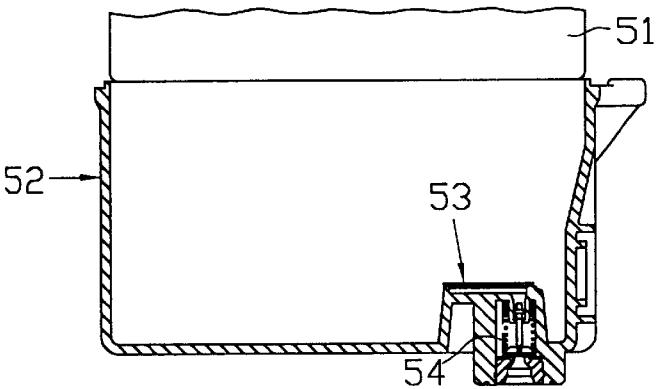
FIG. 8(b) (prior art)
FIGS. 8(*a*), 8(*b*), and 8(*c*) are cross sectional views showing steps of manufacturing a prior art ink cartridge.
Figure 8C:
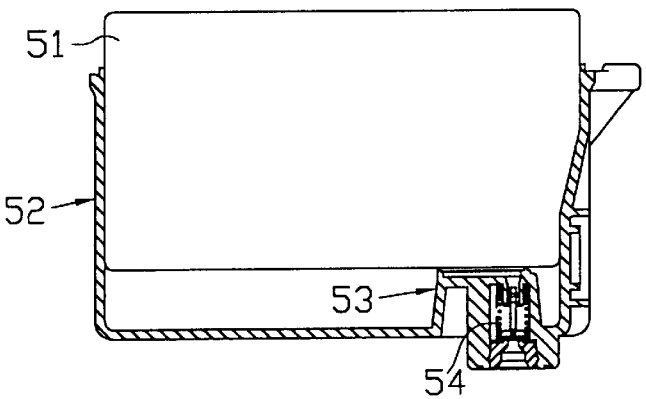
FIG. 8(c) (prior art)
Figure 8A:
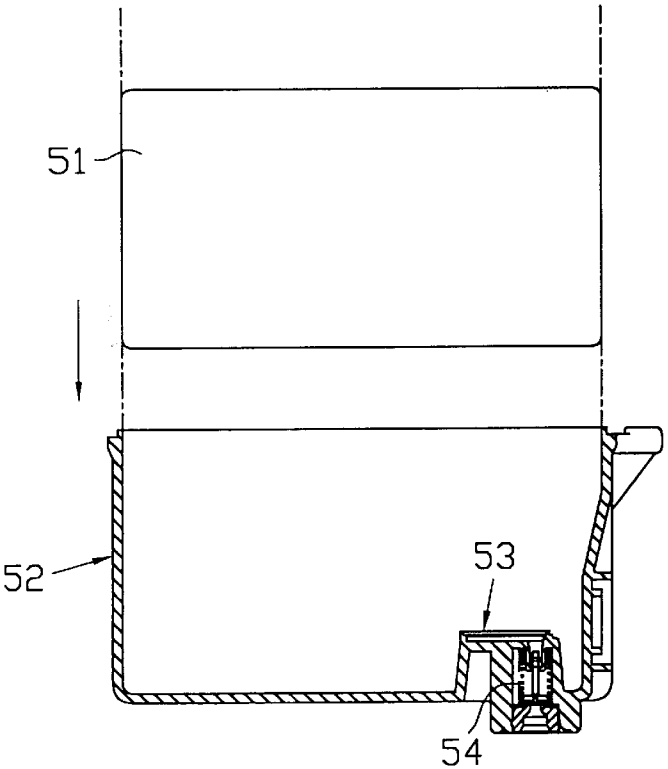
FIG. 8(a) (prior art)

As shown in FIGS. 7(*a*) and 7(*b*), the porous members 12 are squeezed by a pusher 25 against the internal bottom surfaces of the respective storage chambers 14. Each porous member 12 is further squeezed by the pusher 25. The amount of deformation is determined such that the air pockets of the porous member 12 are not destroyed. As shown in FIG. 7(*b*), the amount of deformation is approximately under two-thirds the height of each storage chamber 14. In other words, after being deformed, the porous member 12 is approximately one third of its original height. However, the amount of deformation may be less. The surface of the pusher 25 is substantially shaped like the internal surface of the lid 13.

The above procedures are performed for each storage chamber.

Each porous member 12, which is compressed, gradually returns to its original shape. The top of each porous member 12 reaches a point close to the opening of the storage chamber 14 in about one minute. Therefore, as shown in FIG. 7(*c*), the opening of the container 11 is closed by the lid 13 within one minute after the deformation. The lid 13 is welded to the container 11 to prevent leakage of ink by vibration bonding.

After it is completely inserted into the container 11, each porous member 12 expands to fill gaps created between the porous member 12 and the corresponding storage chamber 14. Accordingly, when ink is supplied to the storage chamber 14 from the ink inlet 15, the porous member 12 absorbs and holds the ink. Then, the seals 26*a* and 26*b* seal the ink inlets 15, air holes 16 and air openings 16*b*, so that the container 11 is sealed hermetically.

The method has the following advantages.

The insertion of porous members 12 has two steps. First, every other porous member 12 is inserted into corresponding storage chambers 14. Secondly, after a predetermined time interval, the remaining storage chambers 14 are filled with the remaining porous members 12. Each porous member 12 is inserted into the corresponding storage chamber 14 at a different time from the adjacent porous member 12. Accordingly, the insertion of one porous member 12 into the corresponding storage chamber 14 does not interfere with the insertion of the adjacent porous member 12. Therefore, all the porous members 12 are smoothly inserted into all the storage chambers 14 regardless of the number of the chambers 14.

The jig 28 deforms the bottom of each porous member 12 to substantially conform to the shape of the internal bottom surface of the corresponding storage chamber 14. Accordingly, when each porous member 12 is inserted into the corresponding storage chamber 14, very little space is created between the internal bottom surface of the storage chamber 14 and the porous member 12. Therefore, each porous member 12 substantially fills the corresponding storage chamber 14 despite the complicated shape of the container 11. It is not necessary to divide the container 11 into plural parts to facilitate the insertion of the porous member 12.

Before the insertion of the porous members 12, the portion of each porous member 12 that corresponds to the projection 19 is indented by the jig 28. When each porous member 12 is inserted into the corresponding storage chamber 14, the projection 19 maintains the indentation. The indented portion of the porous member 12 has relatively small air pockets, as indicated by the small circles in FIG. 6(*b*). Therefore, the indented portion has a greater capillary effect than the surrounding parts of the porous member 12.

Accordingly, the ink contained in the porous member 12 actively moves toward the projection 19, which includes the supply port 18. The ink is efficiently conducted to the outside through the supply port 18 from the storage chamber 14. Therefore, the ink is supplied to the outside without waste, and the quantity of ink remaining in the container 11 is reduced when the cartridge is exhausted.

Before insertion, each porous member 12 is compressed in the lateral direction by the plate-shaped jigs 22. Therefore, when each porous member 12 is inserted into the corresponding storage chamber 14, friction generated between the porous member 12 and the internal wall of the storage chamber 14 is decreased. Accordingly, the porous member 12 is not impeded.

While inclined relative to the container 11, the porous member 12 is inserted into the container 11. Therefore, the porous member 12 does not interfere with the upper edge of the container 11, so that the insertion of the porous member 12 is easy.

The porous member 12 is inclined such that an end that corresponds to the projection 19 is further away from the container 11 than the opposite end. Therefore, when being inserted into the storage chamber 14, the porous member 12 is smoothly inserted to the bottom of the corresponding storage chamber 14.

If the shape of the storage chambers 14 is complicated, filling every corner of the storage chambers 14 with the porous members 12 is difficult. However, compressing, or squeezing, each porous member 12 into the storage chamber 14 by the pusher 25, substantially conforms each porous member 12 to the shape of the corresponding storage chamber 14. Therefore, although the shape of the storage chambers 14 is complicated, it is possible to fill every corner of the storage chambers 14 with the porous members 12.

When excessive pressure is applied to the porous member 12, the air pockets in the porous member 12 are destroyed. Therefore, the present embodiment limits the compression of the porous members 12 to a predetermined range. Accordingly, the porous member 12 is compressed so that air pockets of the porous member 12 are not destroyed.

The shape of the pusher 25 for squeezing the porous member 12 is similar to that of the internal surface of the lid 13. After the lid 13 is welded to the container 11, the porous members 12 expand to substantially conform to the internal surface of the lid 13. Therefore, there is no gap between the lid 13 and the porous member 12. Thus, injected ink from the ink inlets 15 is quickly absorbed and held in the porous members 12. When the ink is supplied to the porous member 12, the ink is not leaked out of the ink inlet 15.

The shape of the pusher 25 for squeezing the porous member 12 is similar to that of the internal surface of the lid 13. After the lid 13 is welded to the container 11, the porous members 12 expand to substantially conform to the internal surface of the lid 13. Therefore, there is no gap between the lid 13 and the porous members 12. Thus, injected ink from the ink inlets 15 is quickly absorbed and held in the porous members 12. When the ink is supplied to the porous members 12, the ink is not leaked out of the ink inlet 15.

Before the porous members 12, which are compressed by the pushers 25, return to their original shape, the lid 13 is welded to the container 11. Accordingly, the porous members 12 do not prevent the lid 13 from being welded to the container 11.

It should be apparent to those skilled in the art that the present invention may be embodied in many other specific forms without departing from the spirit or scope of the invention. Particularly, it should be understood that the invention may be embodied in the following forms.

The amount of deformation of each porous member 12 may be less than or equal to twice the height of each rib 21.

Before the insertion of the porous members 12 into storage chambers 14, each porous member 12 may be deformed not only in the lateral direction but also in the longitudinal direction, which is perpendicular to the lateral direction.

It is acceptable to create any number of storage chamber 14 in a container 11. If the container 11 has only two storage chambers 14, porous members 12 are inserted into the storage chambers 14 one by one, and there is a time interval between the insertion of the first porous member 12 and the insertion of the second porous member 12. Needless to say, the container 11 may have only one storage chamber 14.

Therefore, the present examples and embodiments are to be considered as illustrative and not restrictive and the invention is not to be limited to the details given herein, but may be modified within the scope and equivalence of the appended claims.

What is claimed is:

1. A method for manufacturing an ink cartridge, wherein the ink cartridge has a container having a storage chamber and a porous member for holding ink, the porous member being contained in the storage chamber, and wherein the container has an ink supply port for conducting ink from the storage chamber, the method comprising inserting the porous member into the storage chamber through an opening of the container while inclining the porous member relative to the storage chamber.

2. The method according to claim 1, wherein the bottom surface of the porous member is inclined relative to the bottom surface of the storage chamber when the porous member is being inserted into the storing chamber.

3. The method according to claim 1, wherein one end of the bottom surface of the porous member corresponds to an internal projection formed in the storage chamber, wherein the projection surrounds the supply port, and wherein the porous member is inclined relative to the storage chamber such that the one end enters the storage chamber after an opposite end of the bottom surface of the porous member has entered the storage chamber.

4. The method according to claim 1, further comprising compressing the porous member against an internal projection that is located on the bottom surface of the storage chamber and has the supply port.

5. The method according to claim 1, further comprising compressing and deforming the bottom surface of the porous member to substantially conform to the bottom surface of the storage chamber prior to the insertion of the porous member.

6. The method according to claim 1, further comprising compressing the porous member in the lateral direction prior to the insertion of the porous member.

7. The method according to claim 1, further comprising:

compressing the inserted porous member toward the bottom surface of the storage chamber; and attaching a lid to the container to close the opening of the container after the compression of the porous member.

8. The method according to claim 7, wherein the porous member is compressed to have the amount of deformation being less than or equal to two-thirds of the container depth.

9. The method according to claim 7, wherein the porous member is compressed to have the amount of deformation being less than or equal to twice the height of a rib, which is located in the internal surface of the lid that faces the storage chamber.

10. The method according to claim 7, wherein the lid is attached to the container within one minute after the compression of the inserted porous member.

11. The method according to claim 7, wherein the inserted porous member is compressed by a pusher having a pushing surface that substantially conforms to the internal surface of the lid that faces the storage chamber.

12. A method for manufacturing an ink cartridge, wherein the ink cartridge has a container having a storage chamber and a porous member for holding ink, the porous member being contained in the storage chamber, and wherein the container has an ink supply port for conducting ink from the storage chamber, the method comprising:

compressing and deforming the bottom surface of the porous member to substantially conform to the bottom surface of the storage chamber; and inserting the porous member into the storage chamber through an opening of the container after the compression of the bottom surface of the porous member.

13. The method according to claim 12, wherein the bottom surface of the porous member is compressed and deformed by a jig substantially conforming to an internal projection that is located on the bottom surface of the storage chamber and has the supply port.

14. The method according to claim 12, further comprising deforming the porous member in the lateral direction prior to the insertion of the porous member.

15. A method for manufacturing an ink cartridge, wherein the ink cartridge comprises a container having a plurality of storage chambers and a plurality of porous members for holding ink, each porous member being contained in one of the storage chambers, the method comprising inserting the porous members into the storage chambers, wherein each adjacent pair of the porous members are inserted into the corresponding storage chambers separated by a predetermined time interval.

16. A method according to claim 15, wherein some of the porous members are first inserted into the corresponding storage chambers, arranged in parallel, at one chamber intervals, then the other porous members are inserted into the remaining storage chambers.

17. The method according to claim 15, wherein, when being inserted into the corresponding storage chamber, each porous member is inclined relative to each storage chamber.

18. The method according to claim 15, further comprising compressing and deforming the bottom surface of each porous member to substantially conform to the bottom surface of the corresponding storage chamber prior to the insertion of the porous member.

19. The method according to claim 15, further comprising:

compressing each inserted porous member toward the bottom surface of the corresponding storage chamber; and attaching a lid to the container to close an opening of the container after the compression of the inserted porous members.

* * * * *